United States Patent [19]

Witkin

[11] 3,931,382

[45] Jan. 6, 1976

[54] METHOD FOR RAPID ISOSTATIC PRESSING

[75] Inventor: Donald E. Witkin, Warren, Pa.

[73] Assignee: National Forge Company, Irvine, Pa.

[22] Filed: Jan. 27, 1975

[21] Appl. No.: 544,646

Related U.S. Application Data

[63] Continuation of Ser. No. 359,224, May 11, 1973, abandoned.

[52] U.S. Cl. ..... 264/88; 264/111; 264/313; 264/DIG. 50; 425/405 H

[51] Int. Cl.[2] ..... B29F 3/04

[58] Field of Search ..... 264/109, 110, 111, 313, 264/DIG. 50, 88; 425/405 H

[56] References Cited

UNITED STATES PATENTS

| | | | |
|---|---|---|---|
| 3,551,946 | 1/1971 | Backer et al. | 264/111 |
| 3,599,281 | 8/1971 | Boyer | 264/111 |
| 3,741,755 | 6/1973 | Allen | 264/111 |

*Primary Examiner*—Robert F. White
*Assistant Examiner*—T. E. Balhoff
*Attorney, Agent, or Firm*—Alfred L. Michaelsen

[57] ABSTRACT

Method for compacting preheated powder bodies in a high pressure isostatic pressure vessel in which a liquid such as water is used as the pressurizing medium. A preheated workpiece is inserted into the vessel which is closed and sealed. The vessel is then rapidly filled with the liquid pressurizing medium while avoiding contact of the medium with the preheated workpiece until the vessel is substantially completely full. The pressure within the vessel is then increased rapidly to a preselected compacting level by continually pumping the liquid pressurizing medium into the vessel. The preselected compacting pressure is in excess of the critical pressure of the liquid pressurizing medium. The rapid increase of pressure within the vessel to a level exceeding the critical pressure minimizes the amount of vapor that is formed in the vessel and reduces heat transfer from the preheated body to the pressurizing system.

In a preferred embodiment, avoidance of contact of the pressurizing medium with the preheated workpiece until the vessel is substantially completely filled is accomplished by the use of a shielding container. Alternative means are disclosed. Means for increasing the temperature of the workpiece after it is inserted into the pressure vessel are disclosed. Means for rapidly reducing the pressure within the vessel and for withdrawing the pressurizing medium are also disclosed.

17 Claims, 19 Drawing Figures

METHOD FOR RAPID ISOSTATIC PRESSING

This is a continuation, of application Ser. No. 359,224, filed May 11, 1973, now abandoned.

BACKGROUND OF THE INVENTION

The present invention relates to the formation of products by hot isostatic pressing, and more particularly to a method for the rapid hot isostatic pressing of materials by the use of a liquid pressure medium.

Heretofore in the hot isostatic pressing of powder particles the pressure medium used has most commonly been an inert gas such as nitrogen, helium or argon. It is known, for example, that finely divided metal powders may be compacted into articles approaching 100% of theoretical density by placing a charge of powdered metal in a container, sealing, heating and evacuating the container, transferring the container to a pressure vessel or autoclave and subjecting the container and its contents to the application of high gas pressure. See, for example, U.S. Pat. No. 3,450,528 to Thompson.

It is also known that cold isostatic pressing may be accomplished by subjecting powder particles contained in a flexible mold to either gas or liquid pressure. See, for example, the description of prior art practices in U.S. Pat. No. 3,562,371 to Bush.

U.S. Pat. No. 3,577,635 to Bergman et al. discloses the isostatic compaction of powder bodies wherein the pressurizing medium is a liquid. That patent states that the container in which the powder particles are enclosed "may possibly also be heated to a certain extent," but there is no description given as to how powdered material heated, for example, to a compacting temperature of 2200°F. may be isostatically pressurized.

Other examples of known methods and apparatus for the hot isostatic pressing of powder particles are disclosed in U.S. Pat. No. 3,427,011 to Boyer et al. The Boyer et al. patent refers repeatedly to the use of gas pressure as the pressurizing medium but also states that "liquids may be acceptable for particular operations" (col. 9, lines 17–18). However, no description is given as to how a liquid may be used for hot isostatic compaction. A detailed description of a typical gas pressure autoclave for the hot isostatic compaction of powder particles is given in the article entitled "Operation of High-Gas-Pressure Autoclaves at High Internal Temperatures" by Boyer et al., published Aug. 17, 1965 by Battelle Memorial Institute of Columbus, Ohio.

One of the problems encountered in the use of gas as the pressurizing medium in hot isostatic pressing is the time consumed in carrying out the process. A relatively long period of time is required adequately to heat the part to be compacted and to raise the pressure of the gaseous pressure medium to the desired level. Various techniques have been suggested for reducing the time it takes to hot isostatically press a powder part by means of a gaseous pressure medium. For example, U.S. Pat. No. 3,450,528 to Thompson discloses a process in which the powder metal charge is preheated before introducing it into the pressure vessel and subjecting it to high fluid pressure. However, Thompson states that in fluid-pressure vessels or "autoclaves" of the type used to practice his invention "high pressures are developed by the use of a gas such as helium."

U.S. Pat. No. 3,543,345 to Boyer discloses an apparatus for rapidly compacting articles from fully preheated powder metal charges by the use of a "high-pressure fluid such as helium gas" wherein a first pressure vessel used for compacting the part is pressurized by interconnecting it to a second or storage pressure vessel previously pressurized to a sufficiently high pressure so that when the interconnecting valve is opened the equilibrium pressure achieved in the system is sufficient for compaction of the powdered material. Boyer's system can function only if a gaseous pressure medium is used because it is dependent upon the expansion of the gas from the second or storage vessel to effect rapid pressurization of the first vessel. Boyer's system would not function if the pressurizing fluid were liquid because liquids are insufficiently compressible to pressurize a vessel using the technique described, i.e., the change in volume corresponding to the pressure difference involved would be too small to fill the first pressure vessel containing the powder metal charge.

In addition, while Thompson's and Boyer's improvements may reduce the time period in which the part to be compacted remains in the pressure vessel, they still entail the use of expensive gas compressors, and in the case of Boyer's interconnected pressure vessels, a second pressure vessel to store the compressed gas is essential.

Where gas is used as the pressurizing fluid, large, expensive multistage gas compressors may be required in order to achieve reasonable efficiency in reaching the desired pressure level because of the compressible nature of the fluid being handled. In addition, where gaseous pressure mediums are used, it is frequently necessary to include electrical heating elements within the pressure vessel in order either to raise the temperature of the part to be compacted to the desired level, or to maintain it at that level if the part is heated prior to being introduced into the pressure vessel. In such case, the fluid used as the pressure transmitting fluid will be in intimate contact with the electrical furnace elements and for this reason the fluid itself must be an electrical insulator.

Another problem encountered in connection with the use of a gaseous pressurizing medium is that of maintaining seals to prevent gas leakage. Control of leakage in gas pressurizing systems is difficult and costly. Also where gas is used as the pressurizing medium, high safety factors for the pressure vessels utilized are necessary because of the high compression required.

SUMMARY AND ADVANTAGES OF THE INVENTION

My invention is for a method for rapidly producing hot isostatically pressed parts in which a liquid such as water is used as the pressurizing medium. The method comprises (1) preheating a porous body to be compacted to a temperature sufficiently high for adequate bonding and compacting of the body but below the melting point of the powder material, (2) inserting the preheated part in a dry isostatic pressure vessel which is then sealed, (3) rapidly filling the pressure chamber with liquid while avoiding direct contact of the liquid with the heated body until the pressure vessel is substantially completely full, (4) rapidly increasing the pressure within the vessel to a preselected level sufficient to compact the body by continuing to pump the liquid into the vessel, said preselected pressure level being in excess of the critical pressure of the pressurizing liquid, (5) decreasing the pressure and withdrawing the liquid from the pressure vessel, and (6) opening the pressure vessel and removing the compacted part therefrom.

As will be described more fully hereinafter, a modification of my invention contemplates the use of a heat sink placed within the vessel either shortly before or simultaneously with the insertion of the body in order to raise the temperature of the body to the desired compacting level following its insertion into the pressure vessel.

In using the term "dry" isostatic pressure vessel I mean one in which there is no liquid within the vessel that will come in contact with the preheated body at the time the latter is inserted into the vessel. Contact of the liquid with the preheated body at this time would cause the liquid to vaporize and result in an undesirable loss of heat from the body due to the heat of vaporization.

Heretofore it was thought that the use of a liquid pressurizing medium in hot isostatic pressing was either impossible or impracticable because of the generation of large quantities of vapor when the heated workpiece was brought into contact with the liquid. However, my invention makes possible the use of a liquid such as water as the pressurizing medium even though the workpiece is heated to a temperature well above the boiling point of water, as, for example, to a temperature of 2200°F.

The use of a liquid pressure medium results in several advantages over existing hot isostatic pressing techniques. For example, extremely short cycle times can be achieved thus permitting a substantial saving in operating costs. In using my invention cycle times (from the introduction of the preheated powder part into the pressure vessel to its removal therefrom in completely compacted condition) on the order of one to two minutes may be realized compared to hours required in conventional gas pressurizing. This makes processing of expensive powder parts such as those made from "exotic" metals, super alloys, and tool steels substantially less costly, making their more general application feasible. Moreover, these short cycle times and reduced costs justify the use of hot isostatic pressing techniques with less expensive powder materials.

The use of a liquid instead of a gas pressurizing medium results in substantial savings in capital costs. While the total energy required to raise the pressure of a liquid within a pressure vessel to a given level is approximately equal to that required to raise the pressure of a gas to the same level, the cost of a gas compressor capable of doing the job is substantially higher than the cost of a liquid pump. This is because of the differences in the volume of fluid that the respective devices must handle. For the same mass at atmospheric pressure conditions the volume ratio of a gas such as argon compared to a liquid such as water is approximately 500 to 1. Thus if an equal mass of each medium is to be pressurized to the same level in the same time period, a gas compressor 500 times larger than a liquid pump is required. The attendant expense of such equipment is obvious, and the space required to house a massive gas compressor is substantial. In addition, as pointed out above, because of the compressible nature of the fluid being handled, gas compressors require multiple stages in order to achieve reasonable efficiency. This makes a gas compressor more complex than a liquid pump with a great multiplicity of parts having a deleterious effect upon reliability. In sum, the use of a simple liquid pump rather than a complex gas compressor is of major significance in the successful operation of a production process because of greatly reduced initial costs and greatly enhanced reliability.

In an isostatic pressure system the use of a liquid such as water instead of an inert gas such as argon as the pressurizing medium also represents a significant increase in the safety factor. In all high pressure systems the amount of stored energy is of great concern since this represents the degree of potential hazard involved. Because of its high compressibility a gaseous medium represents a much higher level of stored energy than a liquid. Thus, in the event of a system failure a highly pressurized gaseous medium is capable of transferring more energy (i.e., higher velocities) to broken system fragments than is a liquid under pressure, increasing the risk of serious personal injury or property damage. This increased danger is recognized by boiler and pressure vessel control groups whose regulations require higher safety factors and more stringent inspection criteria for gas filled pressure vessels than for liquid filled vessels.

A still further advantage of using a liquid rather than a gaseous pressurizing medium is that with a liquid, control of the process can be accomplished more easily and with simpler equipment. When using a liquid pressurizing medium the pressure/temperature combination required for compaction is achieved by limiting the maximum pressure that can be reached by the use of an automatic pressure release device of a type well known in the art. The pumping rate of the liquid can be timed to be compatible with the rate of temperature decrease of the workpiece so that maximum pressure is achieved at the moment the workpiece is at the optimum compacting temperature.

A still further advantage in using a liquid rather than a gaseous pressure medium is the savings realized in the cost of the medium. When the pressure medium is water, the cost is practically nil, whereas the cost of using an inert gas such as argon, nitrogen or helium may be considerable.

Reference has also been made to the difficulties that were believed inherent in bringing a liquid into contact with a workpiece heated to high temperature.

The transformation from a liquid to a vapor requires a significant quantity of heat, which causes an excessive cooling or quenching of the workpiece. As will be more fully described hereinafter, my invention limits the amount of liquid that comes into contact with the heated workpiece while the system is at low pressure and in addition reduces the loss of heat due to phase change by rapidly pressurizing the system to raise the pressure above the critical pressure.

With these advantages in mind it is an object of the present invention to provide a method for the hot isostatic pressing of powder particles using a liquid pressurizing medium wherein the change from atmospheric pressure to compacting pressure within the vessel takes place over the shortest possible period of time.

It is a further object of the invention to provide a system for the hot isostatic compaction of powder particles using a liquid pressurizing medium in which the length of time the pressure within the vessel is below the critical pressure of the pressurizing medium is kept to a minimum.

It is still a further object of my invention to provide a system of hot isostatically pressing powder particles in which the loss of heat from the workpiece to the system is reduced to a minimum and in which the period of time that heat transfer from the workpiece to the system takes place prior to reaching the desired compacting temperature is minimized.

It is still another object of my invention to provide a method for hot isostatically pressing powder parts to a density approaching theoretical in a relatively short period thus resulting in faster cycle times for the production of such powder parts.

It is another object of my invention to produce hot isostatically pressed powder parts using lower compacting temperatures as a result of the increased pressures that may be economically realized when using a liquid pressurizing medium.

Further advantages of my invention as well as a complete understanding thereof may be obtained from the following description.

DESCRIPTION OF THE PREFERRED EMBODIMENTS

Figure 1:
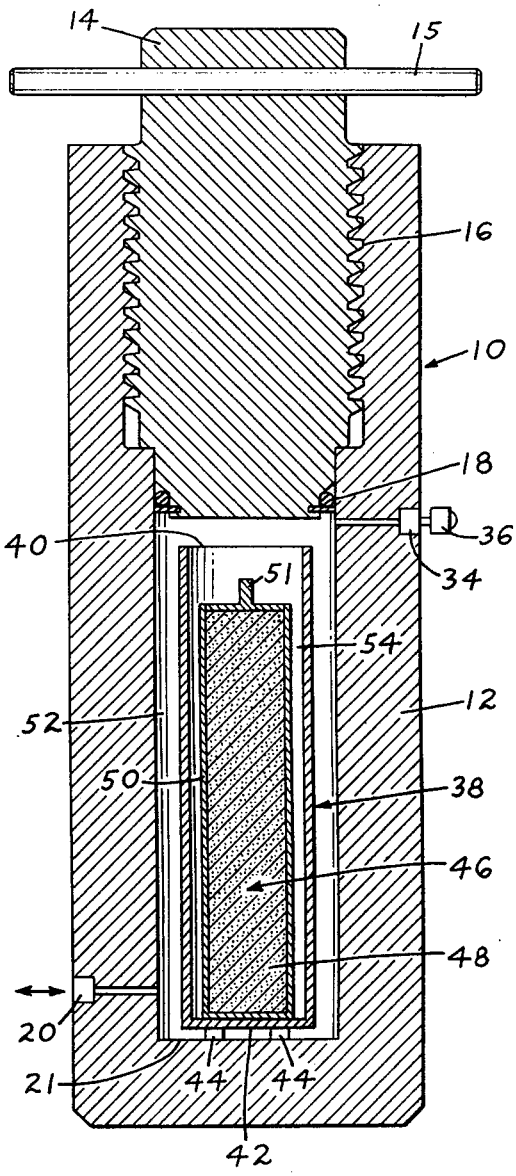
FIG. 1 is s schematic sectional view of a high pressure vessel and shielding container used in practicing my invention. The workpiece is shown in place within the shielding container used in the preferred embodiment of my invention.

FIG. 1 shows a high pressure vessel assembly generally designated 10 having an insulated hollow cylindrical body 12 open at the top to receive a quick opening closure plug 14 that may be turned through handle 15. The vessel may be a standard cold isostatic press with breech type interrupted threads 16. A closure of this type may be inserted rapidly into the vessel and given a one-eighth turn to close, seal and lock the vessel. A conventional seal ring 18 may be employed. While a top opening vessel is shown in the drawings, it will be understood by those skilled in the art that a pressure vessel having a bottom opening may be utilized in practicing my invention.

Figure 3:
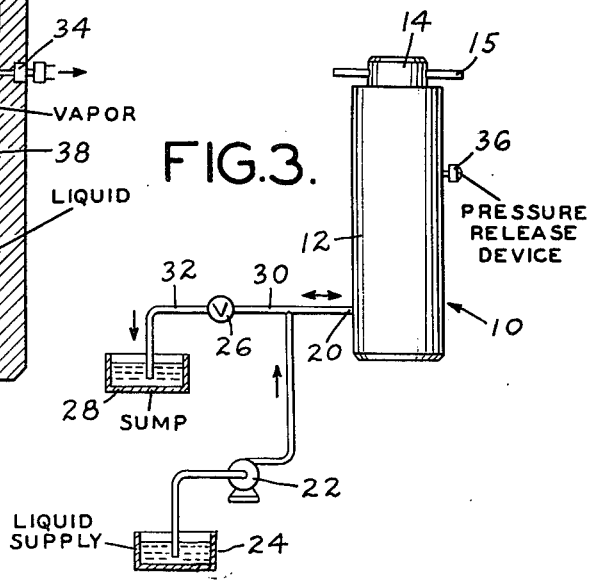
FIG. 3 is a schematic representation of the liquid pressure system used in practicing the invention.

The pressure vessel is connected at port 20 to a pumping system, shown schematically in FIG. 3, capable of pumping a liquid such as water at a very high volume into the pressure vessel and to rapidly raise the pressure of the liquid within the vessel to the compacting level desired. In the embodiment shown schematically in FIG. 3, a single pump 22 is illustrated. It will be understood by those skilled in the art that the pumping system may comprise a very high volume, low pressure (i.e., less than 100 atmospheres) stage to fill the pressure vessel very rapidly and a suitable capacity high pressure stage to then pressurize the liquid within the pressure vessel to the desired high compacting level within a short time interval. The pump 22 is connected to a source of liquid 24.

The port 20 is placed in or near the bottom 21 of the vessel 12 and is also connected to a quick opening drain valve 26 (FIG. 3). The drain valve is of a size sufficient rapidly to vent the liquid contained within the vessel to sump 28. Valve 26, when closed, permits liquid from source 24 to be pumped into the pressure vessel 12 through high pressure piping 30 and port 20. When the pumping action of pump 22 is terminated and valve 26 is opened, liquid is withdrawn from the pressure vessel 12 through port 20, high pressure pipe 30, valve 26 and pipe 32 into sump 28.

While only one inlet-outlet port 20 is shown, it will be understood that the pump could be connected to the interior of the vessel through one port and the drain valve could be connected through a separate port.

The interior of pressure vessel 12 is also connected through port 34 near the top of the vessel to a pressure release device 36. Pressure release device 36 may be a frangible disc assembly of a construction known to those skilled in the art or, alternatively, may be a quick release valve or the like. In my preferred embodiment, I use a frangible or so-called "rupture disc assembly" having a preselected burst pressure. In this type of assembly the rupture disc will burst when the pressure within the vessel reaches a preselected pressure, for example 29,000 psi. Higher or lower pressures could, of course, be selected. The port 34 and pressure release device should be of a size (i.e. diameter) sufficient to rapidly vent any vapor formed within the vessel as will be more fully described hereinafter.

While only one pressure release device 36 is shown, additional frangible disc assemblies set to pressures above the setting on pressure release device 36 but below a safe limiting pressure rating of the vessel may be installed. These additional assemblies may be selected to rupture at increasing pressures to increase sequentially the vent openings in the event of an inadvertent pressure rise.

A dynamic pressure sensing device (not shown), such as a strain gauge type transducer, may be connected to the pressure vessel and to a suitable recording instrument, if desired, to produce permanent records of the pressures within the vessel.

Within the pressure vessel there is positioned an inner or shielding container 38 of cylindrical shape fabricated of a relatively thin metal. Container 38 is open at the top 40 and liquid tight at the bottom 42 and is spaced from the bottom 21 of pressure vessel 12 by supporting legs 44. The cylindrical side wall of shielding container 38 is spaced radially from the inside wall of pressure vessel body 12.

Within the inner or shielding container 38 and supported by the liquid tight bottom 42 there is shown a workpiece generally indicated at 46. In the embodiment shown the workpiece is cylindrical and comprises powder particles 48 contained in can 50 evacuated through sealed evacuation tube 51. Alternatively, the workpiece may be uncanned, i.e., it may be self-supporting, partially compacted and sintered body of powder particles with no surrounding or protective covering. It need not be cylindrical but may be of any shape that will fit within container 38 as described below. Where a can is used it should be of a material compatible with the temperature required to achieve a high density compact at the selected pressure, i.e., the material of the can should not melt, but should be adequately plastic to permit the desired compaction of the particles within the container. In addition, the can material should be chemically compatible with the powdered particles in order to avoid contamination of the powder particles or the formation of eutectic compositions with undesirably low melting points.

The inner or shielding container 38 and the workpiece 46 should be dimensioned to provide a relatively close fit therebetween. However, there should be sufficient clearance between the walls of the container and the workpiece to permit easy and rapid insertion of the workpiece into the container. As shown in the drawings, the cylindrical wall of shielding container 38 extends above the top of the workpiece and is spaced from the pressure vessel wall and from the pressure vessel bottom by the supporting legs 44 by an amount that will prevent excessive heat transfer from the workpiece to the pressure vessel. For most cases a spacing of one-half inch to 1 inch is sufficient.

The shielding container 38 is spaced both from the internal wall of the pressure vessel 12 and from the external surface of the workpiece to provide a first annular space 52 within the pressure vessel between the pressure vessel and the container and a second space 54 within the pressure vessel between the container and the workpiece. Where the workpiece is cylindrical, as shown in FIG. 1, the second space will also, of course, be annular.

In the preferred embodiment of my invention the volume of the annular space 52 between the cylindrical wall of the pressure vessel 12 and the shielding container 38 is approximately 10 times the volume of the annular space 54 between the work piece 46 and the shielding container 38.

The shielding container is placed within the pressure vessel and relative to the workpiece in such a manner that liquid entering the pressure vessel through port 20 will substantially completely fill the annular space 52 between the shielding container and the pressure vessel wall before the liquid spills over the open top 40 of the container 38 to come in contact with the workpiece 46.

Figure 2A:
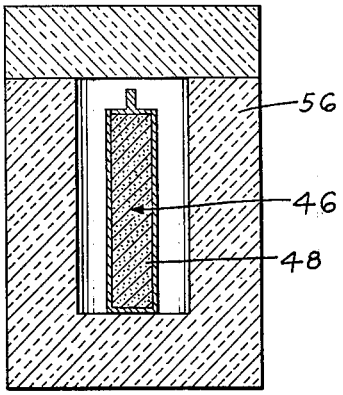
FIGS. 2A through 2H, 2J and 2K schematically represent the several steps followed in practicing my invention.
Figure 2B:
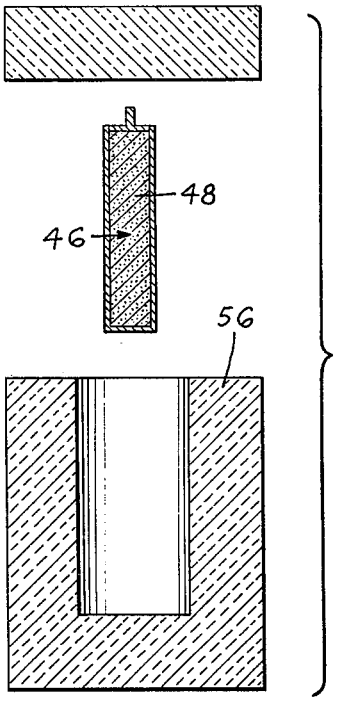

FIGS. 2A through 2K illustrate schematically the several steps followed in practicing the method of my invention. In FIG. 2A the workpiece (either a can filled with powdered material which is thereafter evacuated and sealed, or a partially compacted and sintered powder body) is placed within a conventional heating furnace for a period of time sufficient to achieve isothermal conditions within the can and to heat the contents thereof to a temperature above the desired compacting temperature but below the fusion temperature of the powder particles. Preheating the workpiece to a temperature above the compacting temperature permits of some heat loss from the workpiece as it is transferred to, inserted into and pressurized within the pressure vessel. The preheating temperature should be sufficiently high so that the temperature of the workpiece will be at the desired compacting temperature when the preselected compacting pressure is achieved, as will be hereinafter described.

In compacting either iron base powder particles or nickel base powder particles I have found that preheating the workpiece to about 2200°F. is satisfactory.

Figure 2C:
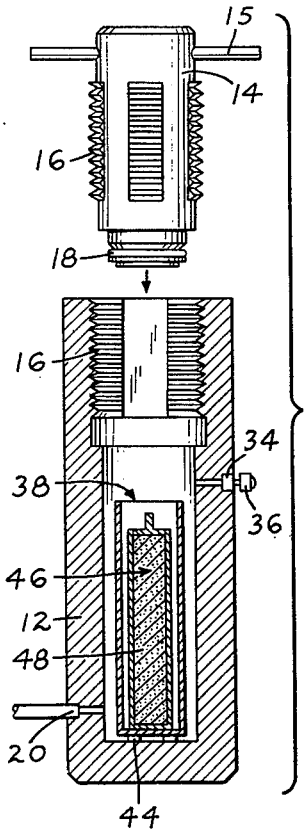

The preheated workpiece is removed from the furnace (FIG. 2B) and placed within the inner or shielding container 38 of isostatic pressure vessel 12 (FIG. 2C).

Figure 2D:
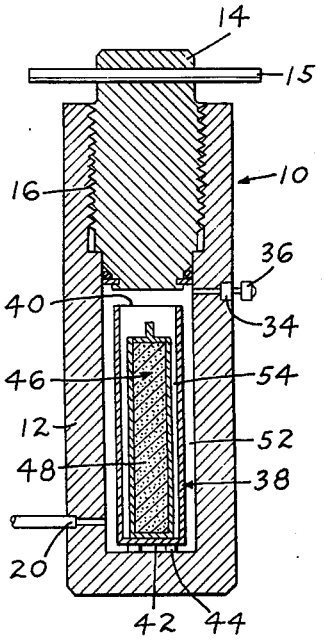
Figure 2E:
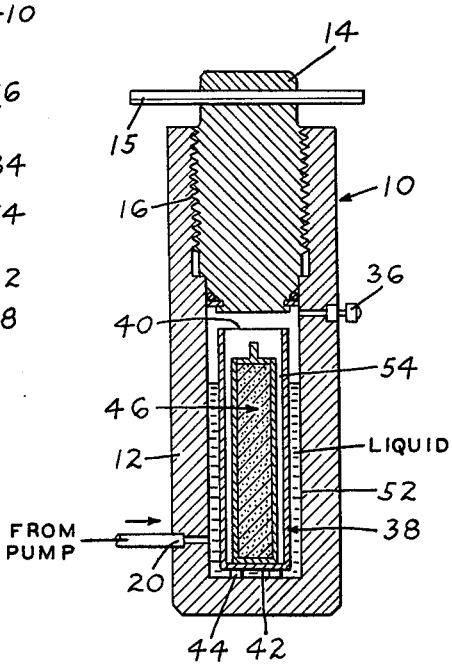

The pressure vessel is then closed, locked and sealed (FIG. 2D). Pump 22 (FIG. 3) is then actuated to pump liquid (shown by the dash lines in FIG. 2E) rapidly into the annular space 52 between shielding container 38 and the wall of the pressure vessel. It is essential in this step that the pressure vessel be substantially completely filled with liquid before the liquid is permitted to come into contact with the heated workpiece 46.

In my preferred embodiment water is used as the liquid pumped into the vessel, although it would be understood that other liquids such as natural and synthetic hydrocarbons, synthetic hydraulic fluids such as phosphate esters, various glycerines and glycols may be used as the pressure medium. The criteria for selecting a pressure medium when practicing my invention include that the pressure medium be liquid at room temperature and that it be compatible, at the temperature and pressure encountered, with the workpiece and with the material constituting the inner or shielding container 38.

It will be recognized that where a liquid comes into contact with a workpiece heated to a temperature approaching 2200°F., large quantities of vapor will be generated. It is for this reason that contact of the liquid with the heated workpiece must be avoided until the vessel is substantially completely full. I have found that when the ratio of the annular space 52 to the annular space 54 is greater than about 10 to one, the danger of creating excessive quantities of vapor is avoided. It will be understood, of course, that the quantity of vapor produced is also a function of the speed with which the pressure vessel is completely filled as well as the length of time it takes for the pressure within the vessel to be raised above the critical pressure of the liquid pressure medium being utilized. Therefore the rate at which liquid is pumped into the vessel is of significance.

Figure 2F:
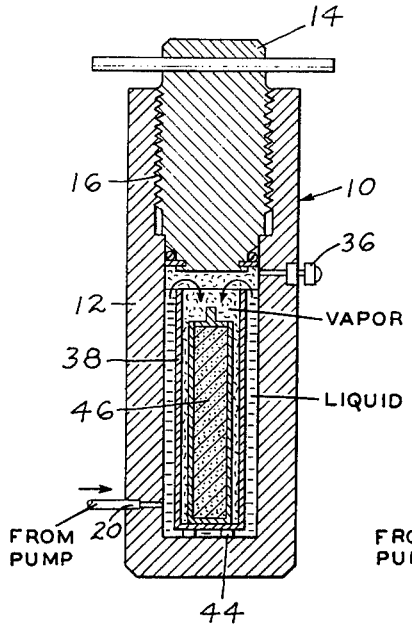

As shown in FIG. 2F, as soon as the level of the liquid pressure medium in the vessel reaches the open end of shielding container 38, the liquid will begin to cascade down upon the workpiece 46 and at the temperatures involved in hot isostatic compaction the liquid that comes into contact with the workpiece will undergo a phase change to vapor. This phase change requires a substantial quantity of heat which causes excessive cooling (quenching) of the workpiece. It is therefore desirable to either prevent, or at least minimize, this quench effect. To accomplish this the rapid pumping of the liquid into the vessel is continued until the desired compacting pressure is reached. In the embodiment shown the selected compacting pressure is 29,000 psi. This pressure is well above the critical pressure of water (3206 psi). It is known that the critical pressure of a substance is that point at which the liquid phase and the vapor phase become identical and above which there can be no phase change from liquid to vapor.

Thus, the rapid pressurization of the pressure medium in the vessel will cause the medium to exceed the critical pressure and eliminate heat loss of the workpiece caused by the change of phase from liquid to vapor. The rate of pressure increase within the vessel should be high enough to prevent the formation of vapor within the vessel sufficient to lower substantially the temperature of the heated workpiece prior to the desired compaction of the workpiece.

Figure 2G:
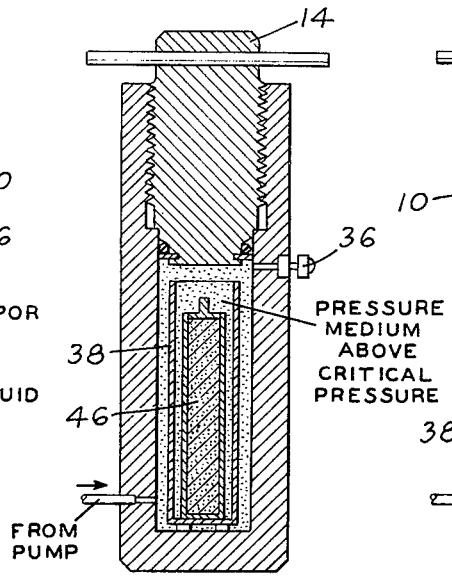

FIG. 2G represents that period in the process where liquid is being continuously pumped into the vessel. Because the pressure of the medium in the vessel exceeds the critical point, no phase change is taking place.

Figure 2H:
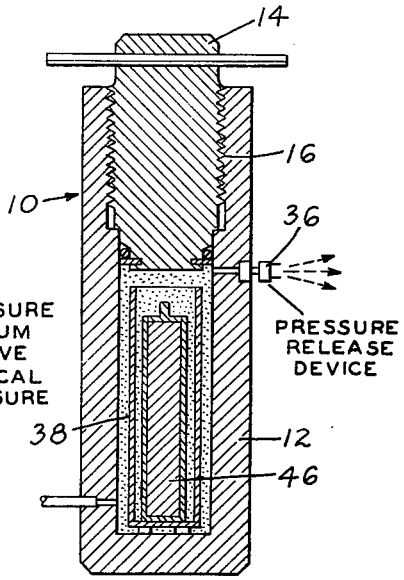
Figure 2L:
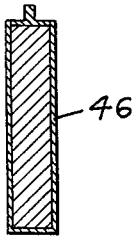
FIG. 2L represents the compacted workpiece removed from the vessel.
Figure 2J:
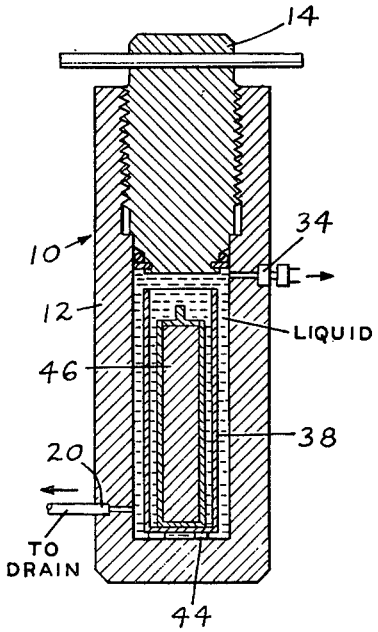
Figure 2K:
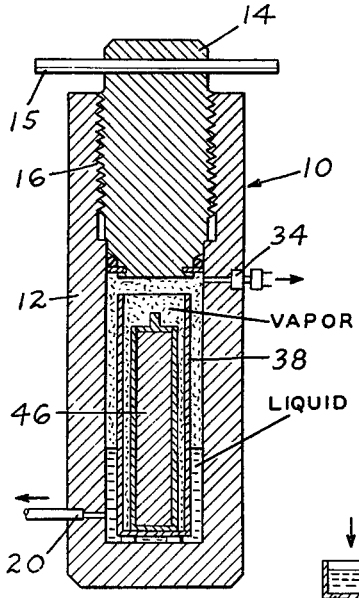

FIG. 2H represents the point in the cycle where the desired preselected compacting pressure has been reached and the pressure releasing device (in the preferred embodiment a frangible disc set to rupture at 29,000 psi) has been activated or blown out. The workpiece is now fully compacted to a density approaching 100% of theoretical. At this point pumping of the liquid into the vessel is discontinued, the valve 26 (FIG. 3) is opened, and pressure is rapidly released. The pressurizing medium is then drained from the pressure vessel (FIG. 2J), with liquid being discharged through the upper port 34 as well as the lower port 20. When the liquid level within the vessel has dropped below the open top 40 of the shielding container the liquid will continue draining through lower port 20 (FIG. 2K). The pressure medium surrounding the workpiece 46 within the shielding container 38 will flash to vapor (the pressure within the system having dropped well below the critical pressure substantially simultaneously with actuation of the pressure release device) and the vapor will continue to vent through upper port 34 and eventually will also escape through lower port 20.

The pressure vessel is then opened by removing the threaded plug 14 and the compacted workpiece 46 is withdrawn from the vessel.

Rapid release of the pressure and draining of the liquid from the pressure vessel is desirable in order to withdraw the compacted workpiece from the vessel before substantial cooling thereof. Many materials commonly processed by hot isostatic compaction, for example, nickel base alloys, are susceptible to cracking if cooling below about 1,200°–1,600°F. takes place too rapidly. Therefore where the workpiece is removed from the pressure vessel at a temperature above 1,700°F. it may be transferred immediately to a controlled furnace atmosphere for further cooling to room temperature.

Once the workpiece 46 has been removed from the vessel, another preheated workpiece may be introduced and the cycle described in connection with FIGS. 2D through 2L repeated.

Figure 4:
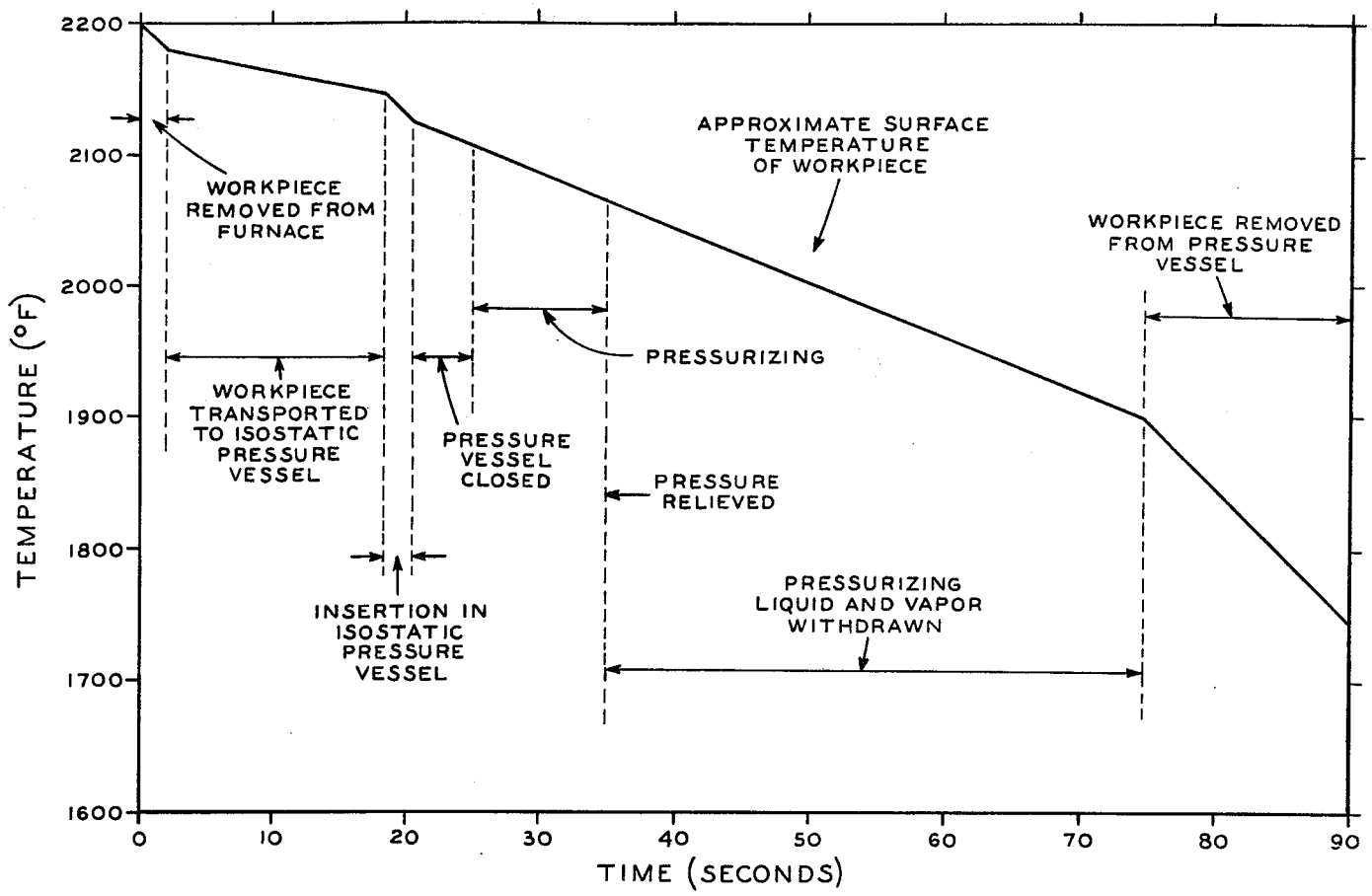
FIG. 4 is a time-temperature chart showing schematically the time period required for carrying out the preferred form of my invention, and the approximate surface temperature of the workpiece during the processing cycle.

FIG. 4 is a time-temperature chart showing schematically the time required to hot isostatically press a can filled with powder particles in accordance with the preferred form of my invention as shown in FIGS. 2A through 2L. It also sets forth the approximate surface temperature of the workpiece during the processing cycle. It is known that the surface temperature of the workpiece as it is withdrawn from the furnace 56 is 2,200°F. and that its surface temperature on being withdrawn from the pressure vessel in its fully compacted state approximately 90 seconds later is about 1,750°F. The surface temperatures shown at intermediate points in FIG. 4 are approximate. As shown in the chart, the surface temperature of the workpiece at the time the preselected compacting pressure is reached—at about 35 seconds after the workpiece is removed from the furnace—is between 2,000° and 2,100°F.

My invention is further illustrated by the following specific examples:

Two canned powder metal samples 2 inches in diameter by 7½ inches long and having a volume ($V_1$) of 23.6 cubic inches were isostatically hot pressed in two separate runs using water as the pressure medium. Sample No. 1 was an iron base powder and sample No. 2 was a nickel base powder. A standard cold isostatic pressure vessel having an interior cylindrical cavity when closed and sealed of 9 inches in length (height) and 3 inches in diameter was used. The pressure vessel was connected through high pressure piping to a Kobe Company Size No. 3 high pressure pump having a capacity of 30,000 psi and delivering 2.9 gallong per minute. A dry cylindrical inner or shielding container made of low carbon steel and having an outside diameter of 2⅜ inches, an inside diameter of 2⅛ inches and an overall height of 8 inches was placed within the pressure vessel. The shielding container was open at the top and water tight at the bottom.

In each run the canned sample was preheated to 2,200°F. in a separate electric furnace and quickly transferred in an insulated bucket from the furnace to the pressure vessel where the sample was placed within the shielding container, as shown in FIGS. 1 and 2C. The vessel was closed, sealed and locked. Water was rapidly pumped into the vessel through the lower port 20, as previously described, until a pressure release device (a frangible disc), preset to rupture at 29,000 psi, was ruptured. The pump was immediately stopped and the valve 26 was opened to drain the vessel rapidly. The vessel was then opened and the completely compacted sample was immediately removed from the vessel.

Following is a record of the times recorded during the two runs:

| | Time-Seconds from Start | |
|---|---|---|
| | Sample No. 1 | Sample No. 2 |
| Remove sample from furnace | 0 | 0 |
| Sample in insulated bucket | 3 | 2 |
| Sample in pressure vessel | 23 | 21 |
| Vessel closed | 30 | 25 |
| Rupture disc ruptered | 41 | 35 |
| Sample removed from vessel | Not Recorded | 75 |
| Temperature of sample 1750 F | Not Recorded | 90 |

The pressurization time was about 6 seconds from the time the pump was loaded.

Upon removal of the workpiece from the vessel it was remeasured and the compaction ratio was determined as follows:

| | Sample No. 1 | Sample No. 2 |
|---|---|---|
| Mean diameter | 1.804" | 1.832" |
| Length | 6.75" | 7.0" |
| Volume ($V_2$) | 17.25in³ | 18.45in³ |
| Compaction Ratio ($V_1/V_2$) | 1.37 | 1.28 |

While my invention is especially useful with a "cold" isostatic pressure vessel, i.e., one in which there is no externally controlled heating means such as resistance heaters, it is also useful with a pressure vessel having heating devices within the vessel.

Figure 5:
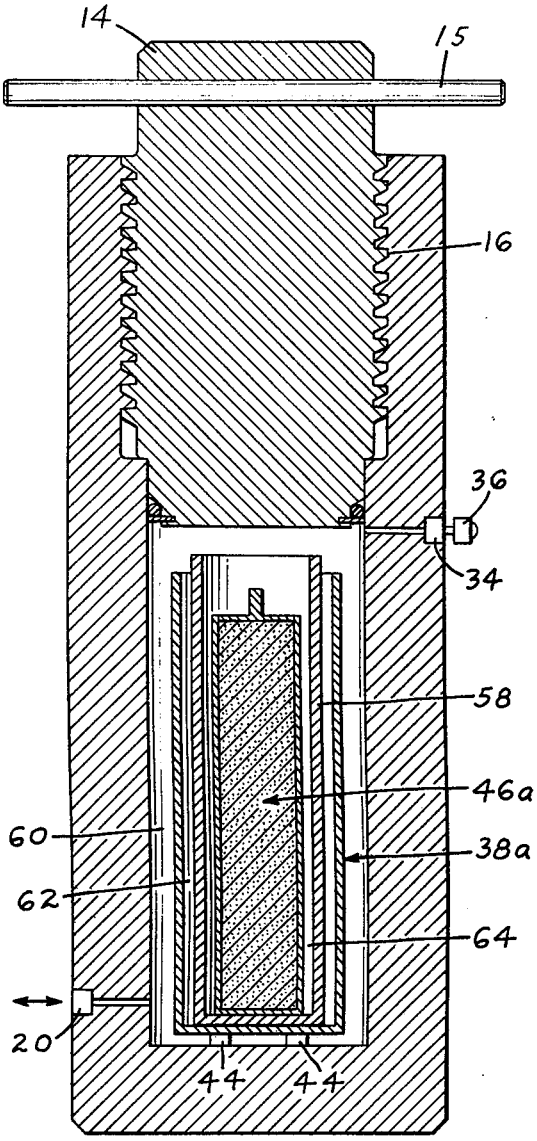
FIG. 5 is a schematic sectional view of a high pressure vessel, shielding container and heat sink used in practicing a modification of my invention. The workpiece is shown in place within the heat sink and shielding container.
Figure 6:
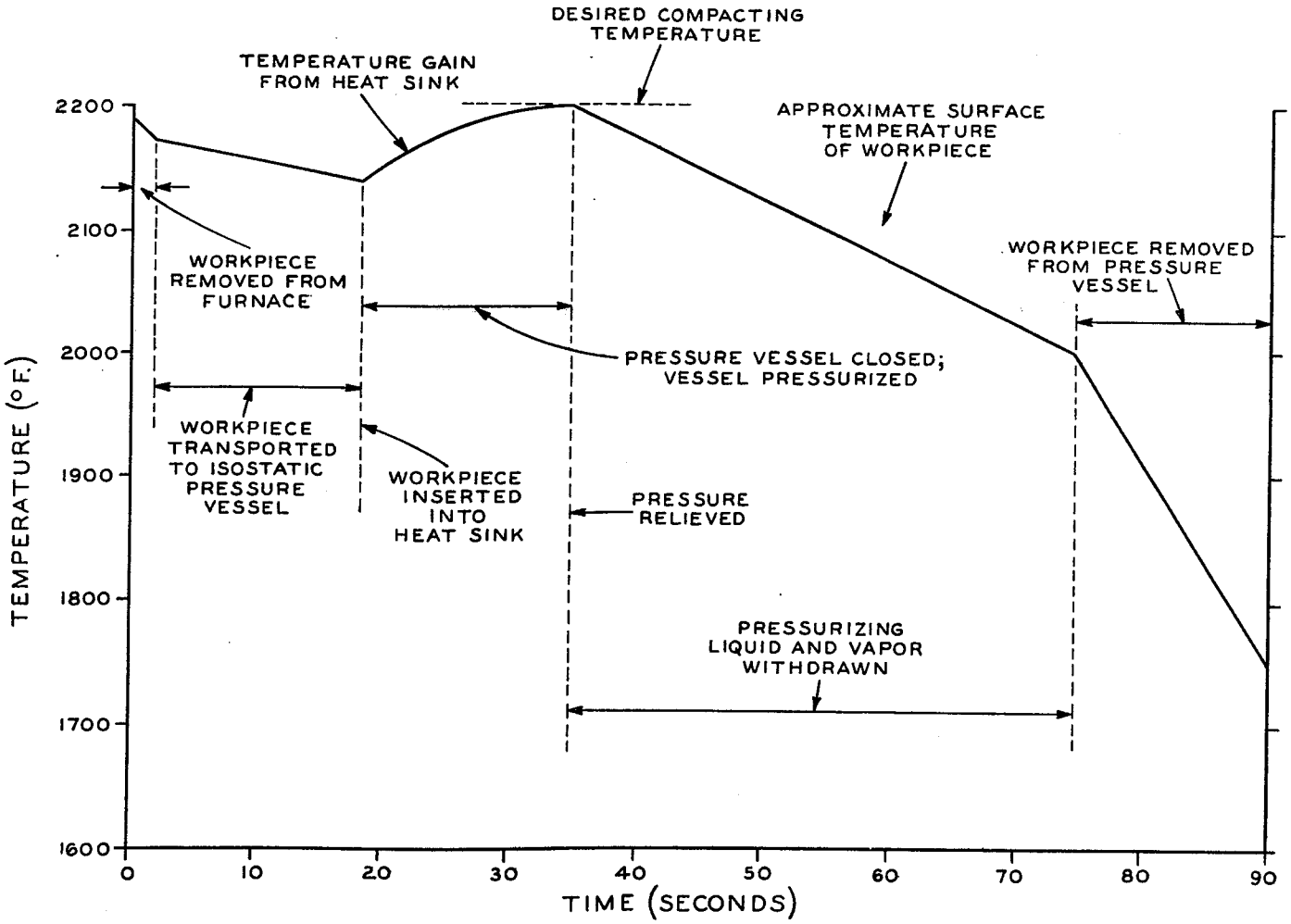
FIG. 6 is a chart similar to FIG. 4, setting forth the approximate time-temperature relationships when using the apparatus illustrated in FIG. 5.

An alternative embodiment of my invention is illustrated in FIGS. 5 and 6. The apparatus illustrated in FIG. 5 is essentially the same as shown in FIG. 1, with one significant difference. In FIG. 5, a cylindrical heat sink 58 is placed between the workpiece 46*a* and the shielding container 38*a*.

The purpose of the heat sink is to transfer a predetermined quantity of heat to a partially preheated workpiece after the workpiece has been placed within the pressure vessel. When a heat sink is used the workpiece need not be preheated to as high an initial temperature as in the preferred embodiment described above, and, in fact, may be preheated to a temperature below the desired compacting temperature. On exposure of the workpiece to the heat sink, heat transfer from the heat sink to the workpiece will raise the temperature of the workpiece to the desired compacting temperature. This allows many sensitive materials to be compacted without running the risk of overheating and possibly damaging the workpiece prior to its insertion into the isostatic pressure vessel. It also makes less critical the handling procedures of the workpiece between the preheating furnace and the pressure vessel.

The amount of heat transmitted from the heat sink to the workpiece can be predetermined and will depend on the respective temperatures of the heat sink and workpiece, their relative masses and the time allowed for heat transfer.

The heat sink should have sufficient mass to be able to raise the temperature of the workpiece by heat transfer to the required compaction temperature when the workpiece is inserted into the heat sink. The inner bore of the heat sink has a diameter that is slightly larger than that of the workpiece, providing rapid heat transfer but having sufficient clearance to permit easy and rapid insertion of the workpiece.

Referring again to FIG. 5, the shielding container 38*a* is placed within the pressure vessel and forms an annular space 60 with the wall of the pressure vessel. The heat sink 58 is in turn placed within the container 38*a* and defines annular space 62 therewith. The workpiece 46*a* is placed within the heat sink 58 and defines a third annular space 64 therewith. The cylindrical wall of the heat sink extends above the top of the workpiece and, to a lesser extent, above the cylindrical wall of the shielding container.

The shielding container 38*a* is made of relatively thin metal. The inside diameter of container 38*a* is slightly larger than the outside diameter of heat sink 58, permitting easy and rapid insertion of the heat sink into the container. Container 38*a* is open at the top and liquid tight at the bottom. Container 38*a* is supported on legs 44 in the pressure vessel and is spaced from the bottom and cylindrical wall of the pressure vessel 12 sufficiently to insure that excessive heat transfer does not take place between the container and the pressure vessel. For most cases a spacing of one-half inch to 1 inch is sufficient.

The volume of the annular space 60 between the pressure vessel wall and shielding container 38*a* is approximately ten or more times greater than the combined volume of annular spaces 62 and 64.

The heat sink is preferably made of metal compatible with the temperature at which the system will be operating. For example, for operating temperatures below 2,200°F. the heat sink may be of copper or steel, whereas above 2,200°F. steel, stainless steel, molybdenum, tungsten or metals or alloys having high strength at elevated temperatures may be utilized. The heat sink is open at the top and liquid tight at the bottom and is supported by the liquid tight bottom of the shielding container 38*a*.

In practicing my invention as shown in FIGS. 5 and 6, the workpiece is heated in a conventional heating furnace to a preselected temperature. In a separate furnace (not shown) the heat sink is heated to a preselected temperature higher than that to which the workpiece is heated. The heat sink is then placed with the pressure vessel in the manner described above and the workpiece is inserted into the heat sink. Alternatively, the workpiece may be inserted into the heat sink outside of the pressure vessel and the assembled heat sink and workpiece then placed in the pressure vessel within shielding container 38*a*. The pressure vessel is then closed and a liquid pressure medium such as water is rapidly pumped into the vessel in a manner such that direct contact of the liquid with the workpiece is avoided until the pressure vessel is substantially completely full. Pumping of the liquid pressure medium is continued at a high rate until the preselected compacting pressure is reached, at which time a pressure release device of the type described above is actuated, pumping is discontinued, and the pressure medium is withdrawn from the pressure vessel.

As shown in FIG. 6, the surface temperature of the workpiece will decrease during the time period that it is being removed from the heating furnace and inserted into the pressure vessel. On exposure to the heat sink the temperature of the workpiece will begin to increase and continue to increase until the desired preselected compacting pressure is reached, at which point pressure within the pressure vessel is relieved. Because the pressure within the vessel is rapidly increased to a point above the critical pressure of the pressure medium, there will be little or no heat loss due to phase transformation from liquid to vapor.

As shown in FIG. 6, the surface temperature of the workpiece at the time it is removed from the furnace is slightly less than 2,200°F. By the time the workpiece has been transported to the isostatic pressure vessel that temperature has dropped to approximately 2,150°F. Insertion of the workpiece into the heat sink increases the temperature of the workpiece to about 2,200°F. which, in the case illustrated, is the desired compacting temperature. On relief of the pressure the temperature of the compacted part begins to decrease.

It will be apparent to those skilled in the art that when practicing the method of my invention it is important that the pressure vessel be substantially full before the liquid pressurizing medium is allowed to come into contact with the workpiece or the heat sink. I have illustrated one means to accomplish this end, namely to substantially completely fill the annular space between the pressure vessel wall and the inner or shielding container before allowing the liquid to spill over the open end of the shielding container to come in contact with either the heat sink or workpiece. Other means of accomplishing this objective are, of course, possible.

Figure 7:
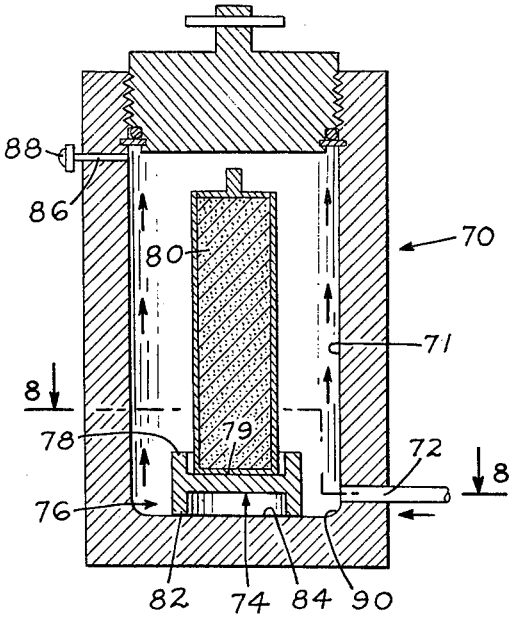
FIG. 7 is a schematic vertical sectional view of a modified form of liquid inlet means for a pressure vessel used in practicing my invention.
Figure 8:
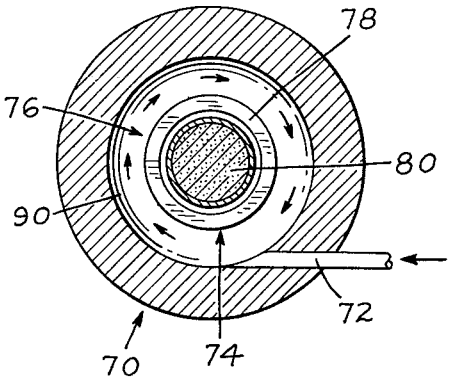
FIG. 8 is a plan sectional view taken generally along the lines 8—8 of FIG. 7.

FIGS. 7 and 8 show a modified form of apparatus that may be used in practicing my invention. In this embodiment, which I refer to as a "vortex fill," the preheated workpiece is separated from the internal surfaces of the pressure vessel by a generally annular space and the liquid pressurizing medium is pumped at high velocity into the space tangentially to the internal surfaces of the pressure vessel to form a liquid vortex while filling the vessel, thereby avoiding direct contact between the pressure medium and the heated workpiece until the vessel is substantially completely filled with the pressure medium.

Referring to FIGS. 7 and 8, pressure vessel 70 has a cover at one end and a cylindrical inner wall 71 with a liquid inlet or port 72 in the lower portion thereof. Inlet 72 is connected to a high volume liquid pump (now shown) and is arranged with respect to the pressure vessel wall to deliver liquid to the interior of the vessel tangentially along the inner wall thereof.

A liquid deflector and work support, generally designated 74, is fitted to the bottom 84 of the pressure vessel. The outer surface of member 74 is generally cylindrical and forms an annular space 76 with the inner cylindrical wall 71 of the pressure vessel in the region of liquid inlet 72. The intersection of the inner cylindrical wall 71 and the bottom 84 of the pressure vessel is rounded as at 90 to provide a smooth surface. Member 74 has an upwardly extending flange 78 to receive and support the workpiece 80 in a central position in the pressure chamber coincident with the center line of the pressure vessel. When inserted in the pressure vessel the workpiece is separated from the inner cylindrical wall of the pressure vessel by a generally annular space. The annular space 76 is smaller than the annular space between the workpiece 80 and the pressure vessel wall 71.

The bottom of member 74 is counterbored to form a downwardly extending annular flange 82 which contacts the bottom 84 of the pressure vessel. The area of contact of the member 74 with the bottom 84 of the vessel is thus minimized, which in turn reduces heat transfer from the workpiece 80 through the member 74 to the pressure vessel 70.

A radially disposed outlet port or opening 86 is provided near the top of the pressure vessel 70. A pressure release device 88 of the type previously described is connected to port 86.

Port 72 is connected by valve means (not shown) to a discharge pipe to drain the vessel as described in connection with my preferred embodiment and as shown in FIG. 3.

In operation, the preheated workpiece is inserted into the pressure vessel and the latter is closed, sealed and locked. A liquid pressurizing medium is introduced into annular space 76 of the pressure vessel at high velocity through inlet 72. The liquid is forced into a vortex by its reaction against the pressure vessel wall and the member 74, thus forming a film or layer of liquid that moves upwardly along wall 71 of the pressure vessel. As the workpiece is positioned in the center of the vortex and spaced from the wall of the vessel it is not contacted by any substantial amount of liquid until the vessel is substantially completely full. As pumping of the liquid into the vessel continues, the thickness of the liquid layer progressively increases and only when the vessel is substantially full with liquid is there any substantial contact between the liquid and the workpiece. When the vessel has been completely filled, rapid pressurization of the liquid to the desired preselected compacting pressure is accomplished, as previously described.

As in my preferred embodiment, when the preselected compacting pressure is reached, the pressure release device is actuated, the pumping of liquid into the vessel is discontinued, and the liquid is withdrawn from the pressure vessel. The fully compacted part is then removed from the vessel.

Figure 9:
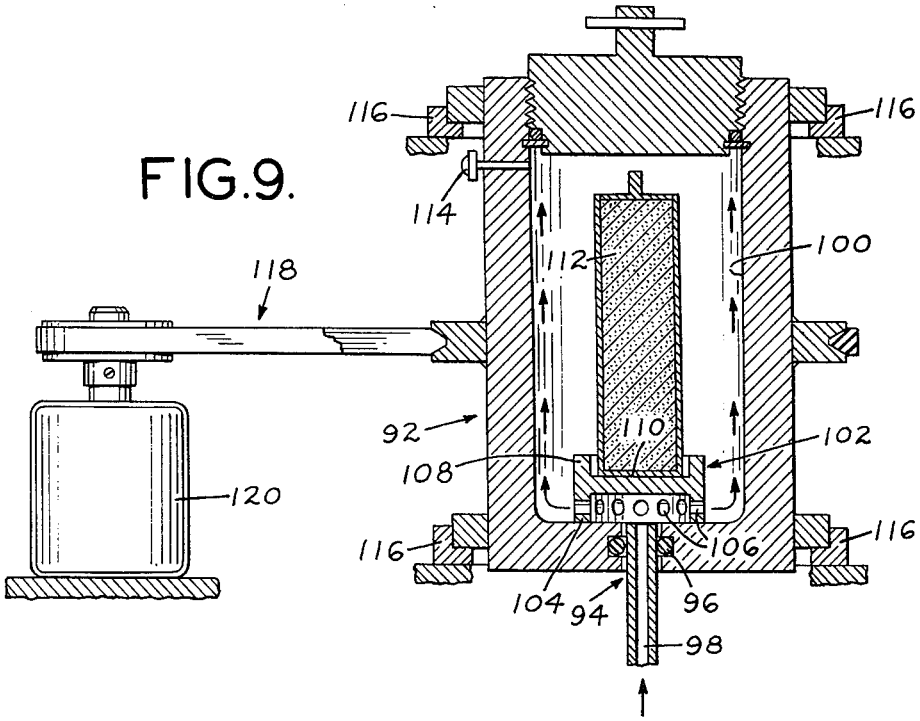
FIG. 9 is a schematic vertical sectional view of a further modification of a pressure vessel used in practicing my invention.

FIG. 9 shows a further embodiment of apparatus that may be used in practicing my invention. In this arrangement the preheated workpiece is also separated from the internal surfaces of the pressure vessel by a generally annular space. A liquid pressurizing medium is pumped into the vessel to fill the space and the pressure vessel is rotated rapidly about its vertical axis during the filling operation. The centrifugal forces created impel the liquid pressurizing medium outwardly from the center of rotation thereby avoiding contact between the pressurizing medium and the workpiece until the vessel is substantially completely filled with the medium.

As shown, cylindrical pressure vessel 92 having a cover at one end is fitted at its opposite end with a rotary joint 94 having appropriate liquid tight sealing means 96. Rotary joint 94 contains a liquid inlet or port 98 coincident with the axis of symmetry of the vessel. Port 98 is connected to a high volume liquid pump (not shown) and is arranged to deliver liquid to the interior of the vessel.

The inner wall 100 of the pressure vessel is cylindrical. A cylindrical work support and deflector member, generally designated 102, is fitted to the bottom of the pressure vessel by downwardly extending flange 104. Flange 104 has ports 106 therein to permit passage of liquid between port 98 and the annular space formed between the inner wall 100 of the pressure vessel and member 102. Member 102 is disposed to deflect incoming liquid from an axial direction as it passes through port 98 to a generally radially outward direction through ports 106, thus causing liquid to flow radially to the pressure vessel wall 100 and there have a rotational velocity imposed on it.

Member 102 has an upwardly extending flange 108 that defines a supporting surface 110 for the workpiece 112. When inserted into the vessel the axis of symmetry of the workpiece is substantially coincident with the axis of symmetry of the vessel, and there is a generally annular space between the workpiece and the inner wall 100 of the vessel.

The vessel is equipped with a pressure release device 114 and a means (not shown) through port 98 for draining the vessel when the pressure release device has been actuated, substantially as described in connection with my preferred embodiment.

The pressure vessel 92 is mounted in bearings 116 to permit rotation of the vessel about its axis of symmetry. The pressure vessel is equipped with a rotary drive, generally designated 118, such as Vee belt, chain, gears, or other device suitable to permit motor 120 to spin the pressure vessel about its axis.

In the operation of the apparatus shown in FIG. 9 the preheated workpiece 112 is placed in the vessel 92 and the vessel is closed, sealed and locked. The vessel is spun by means of the motor 120 and rotary drive 118 at a rate sufficiently high to cause the centrifugal forces created to act upon the pressurizing liquid and impel it outwardly from the center of rotation of the vessel. Liquid is introduced into the vessel through inlet 98 and through ports 106 into the annular space between the wall 100 and member 102. The centrifugal force created by the spinning vessel will cause the liquid to form a layer of film against the wall of the spinning vessel. As pumping of the liquid into the vessel is continued, the thickness of this layer will increase. Because the workpiece is centered in the spinning vessel, there will be minimal contact between the liquid and the workpiece until the pressure vessel is substantially completely filled with liquid. When the vessel is completely filled pumping is continued at a high rate until the preselected compacting pressure is reached, at which point the pressure is released, the pressurizing liquid is drained from the vessel, and the fully compacted part is removed from the vessel as previously described.

Although specific embodiments of the invention have been shown and described herein, it is obvious that other adaptations and modifications may be made by those skilled in the art without departing from the scope and spirit of the appended claims.

I claim:

1. The process of isostatically pressing an article at a temperature above its bonding temperature comprising:

a. inserting said article in a dry isostatic pressing vessel;

b. substantially filling said vessel with a liquid without said liquid contacting said article; and c. filling the remainder of said vessel and raising the pressure of said liquid to a pressure above the critical pressure of said liquid to compact said article before said article cools to a temperature below its bonding temperature.

2. The process of claim 1 wherein approximately nine tenths of said vessel is filled before said liquid contacts said article.

3. The process of claim 1 wherein said vessel is rotating while being filled.

4. The process of claim 1 wherein the liquid stream filling said vessel is substantially tangentially directed with respect to the adjacent vessel wall.

5. The process of claim 1 which further comprises the step of interposing an annular ring between said article and the walls of said vessel whereby said liquid does not contact said article until the annulus between said ring and the wall of said vessel is filled.

6. The process of claim 5 which further includes the step of interposing a second annular ring between said article and said first annular ring wherein the temperature of said second annular ring is greater than the temperature of said article.

7. Method of compacting a porous body by isostatic pressing techniques comprising heating the body to a selected temperature, said temperature being sufficiently high for adequate bonding and compacting of said heated body but below the fusion temperature thereof, inserting said heated body into a dry pressure vessel, closing and sealing the pressure vessel, rapidly pumping a liquid pressurizing medium into said pressure vessel to fill the same while avoiding direct contact of said medium with said heated body until said pressure vessel is substantially completely filled with said medium, rapidly increasing the pressure within the vessel to a preselected level sufficient to compact said body by continuing to pump said pressurizing medium into the vessel until said preselected pressure has been reached, said preselected pressure being greater than the critical pressure of said medium, the rate of pressure increase in said last mentioned step being adequate to prevent the formation of vapor in said vessel as a result of contact of said medium with said body sufficient to lower substantially the temperature of said heated body prior to compaction of said body, decreasing the pressure and withdrawing said medium from said pressure vessel, and removing the body from the pressure vessel.

8. The method of claim 7 in which the pressure vessel is cold.

9. The method of claim 7 in which additional heat is supplied to said body following insertion thereof into said pressure vessel.

10. The method of claim 7 in which said liquid pressurizing medium is water.

11. The method of claim 10 in which the porous body is a metal powder, the selected compacting temperature is about 2,200°F. and the preselected pressure is about 29,000 psi.

12. The method of claim 11 in which the metal powder is an iron base powder.

13. The method of claim 11 in which the metal powder is a nickel base powder.

14. The method of claim 7 in which said body is separated from the internal surfaces of said pressure vessel by being inserted in a shielding container and in which a space is provided between said shielding container and said internal surfaces, said liquid pressurizing medium being pumped into said space to fill the same thereby to avoid direct contact between said medium and said heated body until said pressure vessel is substantially completely filled with said medium.

15. Method of compacting a porous body by isostatic pressing techniques comprising heating the body to a selected temperature, said temperature being sufficiently high for adequate bonding and compacting of said heated body but below the fusion temperature thereof, inserting said heated body into a dry pressure vessel, closing and sealing the pressure vessel, rapidly pumping a liquid pressurizing medium into said pressure vessel to fill the same while avoiding direct contact of said medium with said heated body until said pressure vessel is substantially completely filled with said medium, said body being separated from the internal surfaces of said pressure vessel by a space and said liquid pressurizing medium being pumped at high velocity into said space tangentially to said internal surfaces of said vessel to form a liquid vortex within said space while filling the same, rapidly increasing the pressure within the vessel to a preselected level sufficient to compact said body by continuing to pump said pressuring medium into the vessel until said preselected pressure has been reached, said preselected pressure being greater than the critical pressure of said medium, decreasing the pressure and withdrawing said medium from said pressure vessel, and removing the body from the pressure vessel.

16. Method of compacting a porous body by isostatic pressing techniques comprising heating the body to a selected temperature, said temperature being sufficiently high for adequate bonding and compacting of said heated body but below the fusion temperature thereof, inserting said heated body into a dry pressure vessel, closing and sealing the pressure vessel, rapidly pumping a liquid pressurizing medium into said pressure vessel to fill the same while avoiding direct contact of said medium with said heated body until said pressure vessel is substantially completely filled with said medium, said body being separated from the internal surfaces of said pressure vessel by a space and said vessel being provided with an inlet arranged tangentially to the internal surfaces of said pressure vessel said liquid pressurizing medium being pumped into said space through said inlet at high velocity to form a liquid vortex within said space while filling said space, rapidly increasing the pressure within the vessel to a preselected level sufficient to compact said body by continuing to pump said pressurizing medium into the vessel until said preselected pressure has been reached, said preselected pressure being greater than the critical pressure of said medium, decreasing the pressure and withdrawing said medium from said pressure vessel, and removing the body from the pressure vessel.

17. Method of compacting a porous body by isostatic pressing techniques comprising heating the body to a selected temperature, said temperature being sufficiently high for adequate bonding and compacting of said heated body but below the fusion temperature thereof, inserting said heated body into a dry pressure vessel, closing and sealing the pressure vessel, rapidly pumping a liquid pressurizing medium into said pressure vessel to fill the same while avoiding direct contact of said medium with said heated body until said pressure vessel is substantially completely filled with said medium, said body being separated from the internal surfaces of said pressure vessel by a space, said liquid pressurizing medium being pumped into said space to fill the same, and said pressure vessel being rapidly rotated during the filling of said space to cause centrifugal forces to be exerted on said medium during said filling, rapidly increasing the pressure within the vessel to a preselected level sufficient to compact said body by continuing to pump said pressurizing medium into the vessel until said preselected pressure has been reached, said preselected pressure being greater than the critical pressure of said medium, decreasing the pressure and withdrawing said medium from said pressure vessel, and removing the body from the pressure vessel.

* * * * *

Disclaimer 3,931,382.—*Donald E. Witkin*, Warren, Pa. METHOD FOR RAPID ISOSTATIC PRESSING. Patent dated Jan. 6, 1976. Disclaimer filed June 1, 1976, by the assignee, *National Forge Company.*

Here enters this disclaimer to all claims of said patent.

[*Official Gazette July 27, 1976.*]